US009720358B2

(12) United States Patent
Nihei et al.

(10) Patent No.: US 9,720,358 B2
(45) Date of Patent: Aug. 1, 2017

(54) IMAGE FORMING APPARATUS

(71) Applicant: CANON KABUSHIKI KAISHA, Tokyo (JP)

(72) Inventors: Hironobu Nihei, Yokohama (JP); Naoki Inoue, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/061,112

(22) Filed: Mar. 4, 2016

(65) Prior Publication Data

US 2016/0274512 A1 Sep. 22, 2016

(30) Foreign Application Priority Data

Mar. 18, 2015 (JP) ..... 2015-054897

(51) Int. Cl.
*G03G 15/20* (2006.01)
*G03G 15/00* (2006.01)
*G03G 21/16* (2006.01)

(52) U.S. Cl.
CPC ..... *G03G 15/2053* (2013.01); *G03G 15/2085* (2013.01); *G03G 15/70* (2013.01); *G03G 21/1638* (2013.01); *G03G 21/1685* (2013.01); *G03G 2215/0132* (2013.01); *G03G 2215/2035* (2013.01)

(58) Field of Classification Search
None
See application file for complete search history.

(56) References Cited

U.S. PATENT DOCUMENTS

| | | | |
|---|---|---|---|
| 7,010,255 | B2 | 3/2006 | Yura et al. |
| 7,251,427 | B2 | 7/2007 | Nanataki et al. |
| 7,504,605 | B2 | 3/2009 | Nanataki et al. |
| 9,040,877 | B2 | 5/2015 | Nanataki et al. |
| 2004/0022552 | A1 | 2/2004 | Yura et al. |
| 2004/0161255 | A1 | 8/2004 | Nanataki et al. |
| 2007/0170165 | A1 | 7/2007 | Nanataki et al. |
| 2008/0298863 | A1 | 12/2008 | Nanataki et al. |
| 2011/0064427 | A1 | 3/2011 | Yoshida |

(Continued)

FOREIGN PATENT DOCUMENTS

| | | |
|---|---|---|
| JP | 2004-054225 A | 2/2004 |
| JP | 2004-253177 A | 9/2004 |

(Continued)

*Primary Examiner* — David M Gray
*Assistant Examiner* — Thomas Giampaolo, II
(74) *Attorney, Agent, or Firm* — Fitzpatrick, Cella, Harper & Scinto

(57) ABSTRACT

The image forming apparatus includes a sheet discharge sensor that detects a recording material, a fixing device that nips the recording material to fix an unfixed toner image onto the recording material, a fixing motor that drives the fixing device, and an engine control unit that controls the fixing motor. The fixing device includes a fixing roller, a pressure unit that forms a first nip portion with the fixing roller to press the fixing roller, and a heating unit that forms a second nip portion with the fixing roller to heat the fixing roller. The first nip portion nips the recording material to fix the toner image onto the recording material. When determining that the recording material is wound around the fixing device using the sheet discharge sensor, the engine control unit continues to drive the fixing motor.

21 Claims, 8 Drawing Sheets

(56) References Cited

U.S. PATENT DOCUMENTS

| | | | | |
|---|---|---|---|---|
| 2011/0236084 | A1* | 9/2011 | Nishida | G03G 15/2064 399/328 |
| 2012/0189329 | A1* | 7/2012 | Tamaki | G03G 15/2039 399/38 |
| 2014/0294405 | A1* | 10/2014 | Miyamoto | G03G 15/70 399/21 |

FOREIGN PATENT DOCUMENTS

| | | | |
|---|---|---|---|
| JP | 2011-028212 | A | 2/2011 |
| JP | 2011-064802 | A | 3/2011 |
| JP | 2011-133502 | A | 7/2011 |

* cited by examiner

IMAGE FORMING APPARATUS

BACKGROUND OF THE INVENTION

Field of the Invention

The present invention relates to an image forming apparatus such as a copying machine or a laser printer, and more particularly, to a method of conveying a jammed sheet when a sheet jam occurs in the vicinity of a fixing device.

Description of the Related Art

A phenomenon or a state in which a recording material is not smoothly conveyed to cause clogging, or is retained in a conveyance path in an image forming apparatus is referred to as a jam. For example, after a recording material passes through a fixing nip portion between a fixing roller and a pressure roller of a fixing device, if a leading edge of the recording material stops for some reason and the fixing roller continues to rotate, the recording material is jammed to the leading edge side into the shape of accordion pleats, and is retained. Further, if the fixing roller still continues to rotate, there may be cases in which the recording material bends midway to be wound around the fixing roller (this state is hereinafter referred to as winding jam). If a recording material is wound around the fixing roller, it is difficult to remove the wound recording material. Therefore, when a jam is detected, control is hitherto performed so that the conveyance of the recording material may be stopped as promptly as possible.

For example, in Japanese Patent Application Laid-Open No. 2004-253177, there is disclosed an externally heating type fixing device of an image forming apparatus, which is configured to bring a heating member into contact with a surface of a fixing roller to externally heat the fixing roller, and heat an unfixed toner image on a recording material by the heated fixing roller. In such an externally heating type fixing device, if the conveyance of the recording material is immediately stopped when a winding jam occurs, the bent recording material is not wound around the fixing roller, and is conveyed separately from the fixing roller in a state of being bent midway. Further, for example, in Japanese Patent Application Laid-Open No. 2011-64802, there is disclosed a technology in which, in order to solve a jam by removing a jammed sheet with ease, when a jam occurs, the conveyance is immediately stopped except for a load in the vicinity of an entrance of a post-processing device into which the recording material is introduced, and the conveyance of the load in the vicinity of the entrance of the post-processing device is stopped after a predetermined time period elapses.

In the externally heating type fixing device described above, if the conveyance is immediately stopped except for the load in the vicinity of the entrance of the device when a winding jam occurs, a user who opens a cover of the image forming apparatus in order to remove the jammed sheet visually recognizes the jammed sheet in the following state. Specifically, the user visually recognizes both a bent tip of the recording material that is conveyed separately from the fixing roller, and a trailing edge of the recording material. It is likely that, when the user opens the cover, the user grabs an end portion of the recording material that is visually recognized sooner to remove the recording material. When the grabbed end portion is the trailing edge of the recording material, if the user pulls the end portion in order to remove the recording material, the fixing roller rotates in a direction opposite to a normal direction of recording material conveyance. At that time, the recording material may be torn and the torn piece of the recording material may remain in the image forming apparatus to adversely affect the image forming apparatus. Therefore, in an image forming apparatus having an externally heating type fixing device, it has been desired to allow a user to remove a jammed sheet with ease when a winding jam occurs.

SUMMARY OF THE INVENTION

The present invention has been made in view of the above-mentioned circumstances, and an object of the present invention is to improve usability when a winding jam in a fixing device is solved.

In order to attain the object described above, the present invention has been introduced as follows.

It is provided that, an image forming apparatus including a detection unit configured to detect a recording material, a fixing unit configured to nip the recording material and fix an image on the recording material, a driving unit configured to drive the fixing unit, and a control unit configured to control the driving unit, wherein the fixing unit includes a rotation member, a pressure member configured to form a first nip portion with the rotation member and press the rotation member, and a heating member configured to form a second nip portion with the rotation member and heat the rotation member, the fixing unit fixing the image on the recording material by nipping the recording material at the first nip portion, and wherein the control unit controls the driving unit so that the driving unit continues to drive the fixing unit in a case that the control unit determines that the recording material is wound around the fixing unit based on a detection result of the detection unit.

Further features of the present invention will become apparent from the following description of exemplary embodiments with reference to the attached drawings.

DESCRIPTION OF THE EMBODIMENTS

Embodiments of the present invention are described in detail below with reference to the attached drawings.

First Embodiment

[Structure of Image Forming Apparatus]

Figure 1:
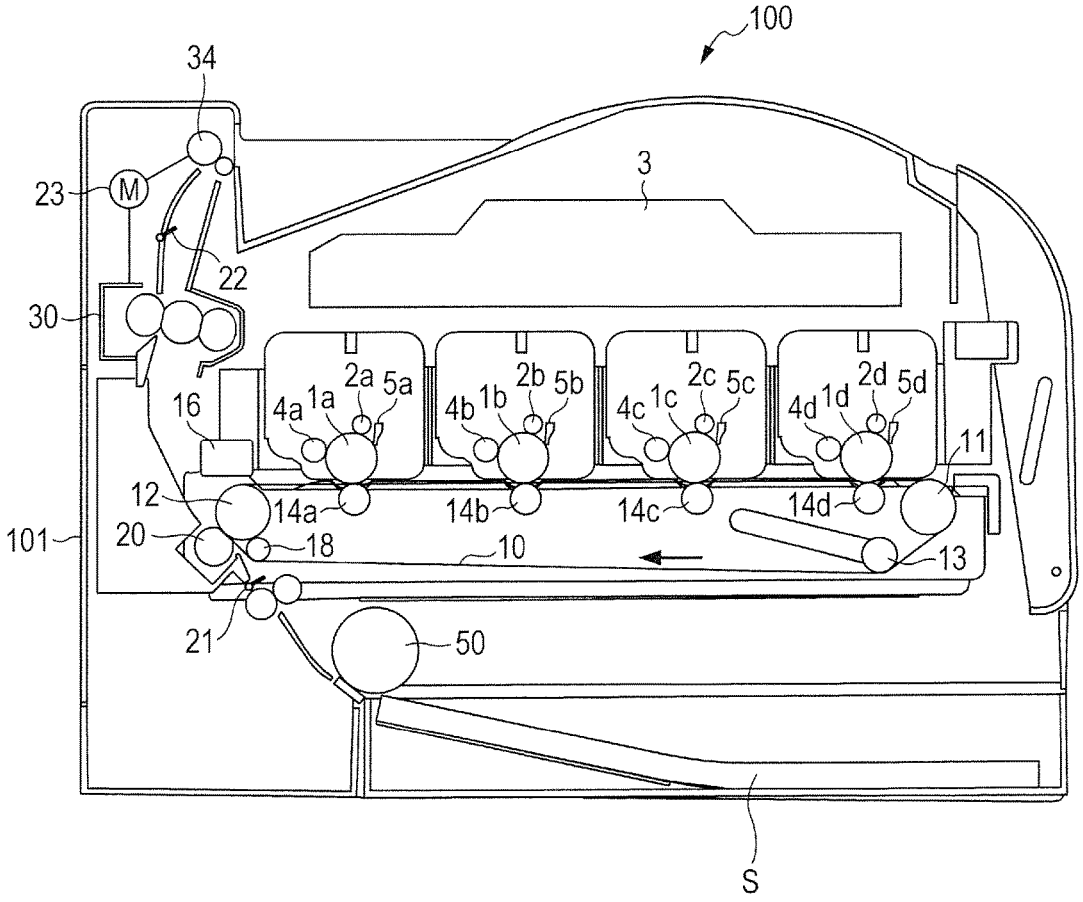
FIG. 1 is a schematic sectional view of an image forming apparatus according to first and second embodiments of the present invention.

As an image forming apparatus according to a first embodiment of the present invention, a color laser printer configured to form a color image using toner of a plurality of colors is described. FIG. 1 is a schematic sectional view of a color laser printer 100 (hereinafter simply referred to as printer 100) as the image forming apparatus according to this embodiment. With reference to FIG. 1, the printer 100 includes photosensitive drums 1*a*, 1*b*, 1*c*, and 1*d* that are photosensitive members in the shape of drums. The suffixes a, b, c, and d of the reference numerals denote yellow (Y), magenta (M), cyan (C), and black (K), respectively, as toner colors. The suffixes a to d are hereinafter omitted except as required in description of a member of a specific color. The photosensitive drum 1 is driven to rotate counterclockwise at a predetermined circumferential velocity (process speed). In the course of the rotation, the photosensitive drum 1 is charged by a charging roller 2 to a predetermined polarity and at a predetermined potential. Then, a laser scanner 3 scans the photosensitive drum 1 to form an electrostatic latent image corresponding to each of the toner colors on each of the photosensitive drums 1. The formed electrostatic latent image is developed by a developing device 4 to be visualized as a toner image.

An intermediate transfer belt 10 is stretched by stretch members (a driving roller 11, an opposing roller 12, a tension roller 13, and an auxiliary roller 18), and is driven to rotate clockwise at a circumferential velocity that is substantially the same as that of the photosensitive drum 1. The toner image formed on the photosensitive drum 1 is transferred onto the intermediate transfer belt 10 through application of a primary transfer voltage to a primary transfer roller 14 when the toner image passes through a portion at which the photosensitive drum 1 and the intermediate transfer belt 10 are in contact with each other. Toner that is not transferred onto the intermediate transfer belt 10 and remains on the photosensitive drum 1 is removed by a cleaning device 5. In this way, toner images in the plurality of colors are superimposed on the intermediate transfer belt 10 to form a toner image corresponding to a full-color image.

Force to drive a pickup roller 50 is supplied from a sheet feed motor (not shown) as a drive source through drive of a pickup solenoid (not shown) to feed a recording material S into a conveyance path. The fed recording material S is conveyed through a registration sensor 21 as a first detecting unit to a secondary transfer portion that is a portion at which the intermediate transfer belt 10 and a secondary transfer roller 20 are in contact with each other (nip portion). The toner image formed on the intermediate transfer belt 10 is transferred onto the recording material S (onto the recording material) when the toner image passes through the secondary transfer portion through application of a secondary transfer voltage to the secondary transfer roller 20.

The recording material S having the unfixed toner image thereon is introduced into a fixing device 30, and the unfixed toner image is fixed onto the recording material S with heat and pressure. The recording material S after the toner image is fixed thereonto is discharged out of the printer 100 by a sheet discharge roller 34. Note that, toner that is not transferred onto the recording material S and remains on a surface of the intermediate transfer belt 10 is removed by a transfer belt cleaning device 16. A fixing motor 23 as a driving unit drives the fixing device 30 and the sheet discharge roller 34. Further, a sheet discharge sensor 22 as a second detecting unit is an optical sensor configured to detect the recording material S that is conveyed through the conveyance path between the fixing device 30 and the sheet discharge roller 34. A rear cover 101 is a cover that is opened and closed when maintenance of the apparatus or the like is performed, and is used when, for example, a jam occurs in the fixing device 30 and a jammed sheet is removed.

[Structure of Fixing Device]

Figure 2B:
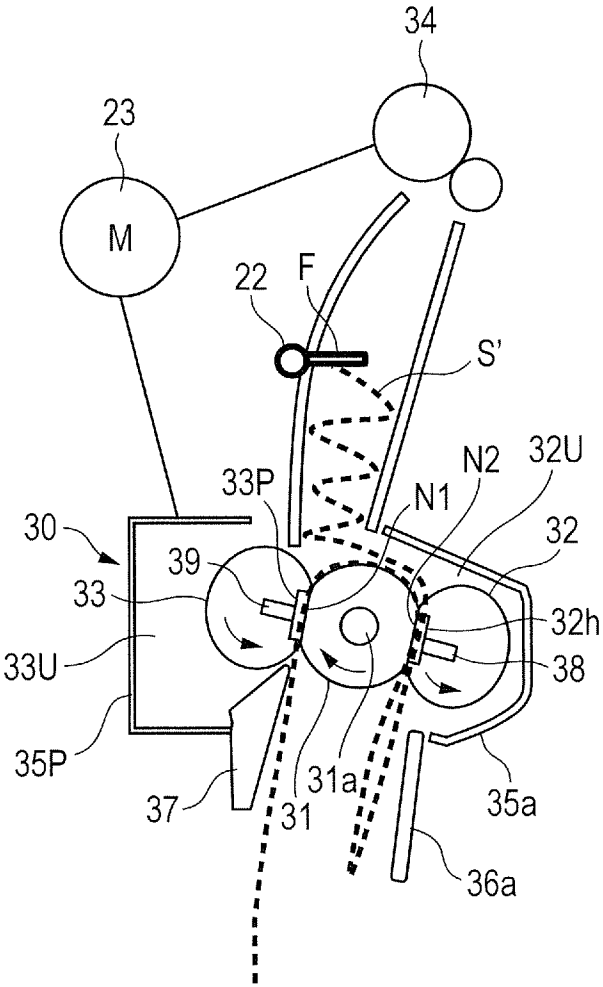
FIG. 2B is an explanatory view of a state of a jammed sheet.
Figure 2A:
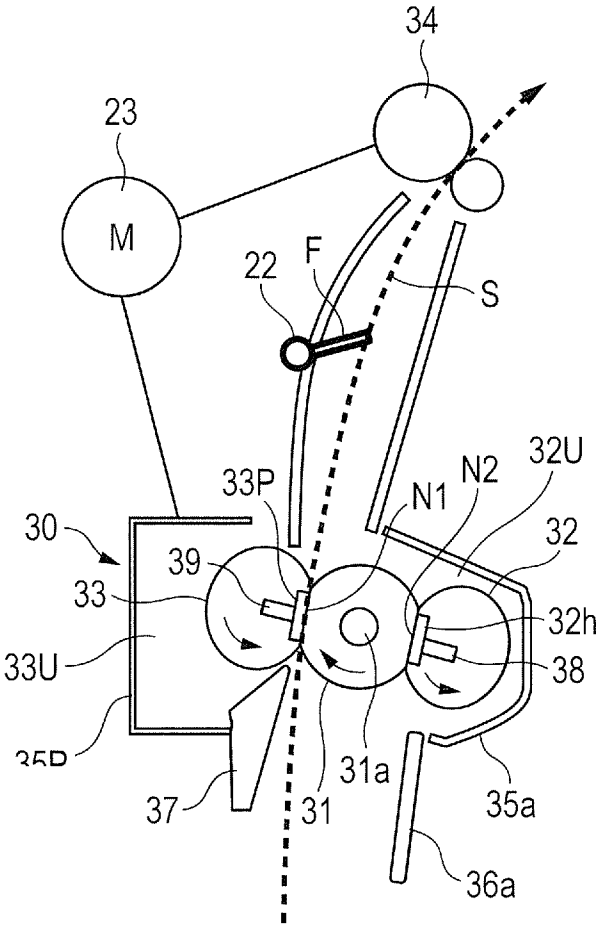
FIG. 2A is a schematic sectional view of a fixing device according to the first embodiment.

Next, a structure of the fixing device (fixing portion) 30 is described with reference to FIG. 2A. FIG. 2A is a schematic sectional view in the vicinity of the fixing device 30 of the printer 100 according to this embodiment illustrated in FIG. 1. The fixing device 30 according to this embodiment is an externally heating type fixing device described above. The fixing device 30 includes a fixing roller 31, a pressure unit 33U as a pressure member, and a heating unit 32U as a heating member. The fixing roller 31 is rotated in a direction of the arrow in FIG. 2A (clockwise) by driving a shaft portion 31*a* of the fixing roller 31 by the fixing motor 23. Further, the fixing roller 31 is a roller including a sponge-like first silicone rubber layer having a high degree of thermal insulation, a second silicone rubber layer formed therearound having a high degree of thermal storage, and a surface layer formed of a fluorine resin.

The heating unit 32U in contact with a surface of the fixing roller 31 to heat the fixing roller 31 includes a plate-like heater 32*h* and a tubular film 32 rotated around the heater 32*h*. The heater 32*h* is pressed against the fixing roller 31 via the film 32 by a spring 38. A nip portion N2 as a second nip portion is a region in which the heating unit 32U and the fixing roller 31 are in contact with each other. The heater 32*h* is a ceramic heater in which a heat generating resistor is formed on a ceramic substrate. The film 32 includes a base layer and a surface layer. The base layer is formed of PI (polyimide) and the surface layer is formed of a fluorine resin.

The pressure unit 33U includes a plate-like pad 33P and a tubular film 33 rotated around the pad 33P. The pad 33P is an aluminum plate and is pressed against the fixing roller 31 via the film 33 by a spring 39. The film 33 includes a base layer and a surface layer. The base layer is formed of PEEK (polyether ether ketone) and the surface layer is formed of a fluorine resin. A nip portion N1 as a first nip portion is a region in which the pressure unit 33U and the fixing roller 31 are in contact with each other.

With reference to FIG. 2A, when the fixing roller 31 is driven in the direction of the arrow in FIG. 2A (clockwise) by the fixing motor 23, both the film 32 and the film 33 are driven to rotate counterclockwise. The recording material S conveyed in a direction of the broken line arrow in FIG. 2A is heated while being nipped at the nip portion N1 and being conveyed. This fixes the unfixed toner image onto the recording material S. The sheet discharge sensor 22 as the optical sensor configured to detect the recording material S is arranged downstream of the nip portion N1 in a conveyance direction of the recording material S. A flag F shields the sheet discharge sensor 22 from light by being pressed by a leading edge of the recording material S being conveyed. On the other hand, when the recording material S conveyed from the fixing device 30 does not exist, the flag F does not shield the sheet discharge sensor 22 from light. In this way, the sheet discharge sensor 22 can detect whether or not the recording material S conveyed from the fixing device 30 exists. Covers 35*a* and 36*a* are device covers configured to house the heating unit 32U therein, and a cover 35P is a device cover configured to house the pressure unit 33U therein. A guide 37 is a guide member arranged so that the recording material S may be introduced into the nip portion N1 of the fixing device 30.

[System Configuration of Image Forming Apparatus]

Figure 3A:
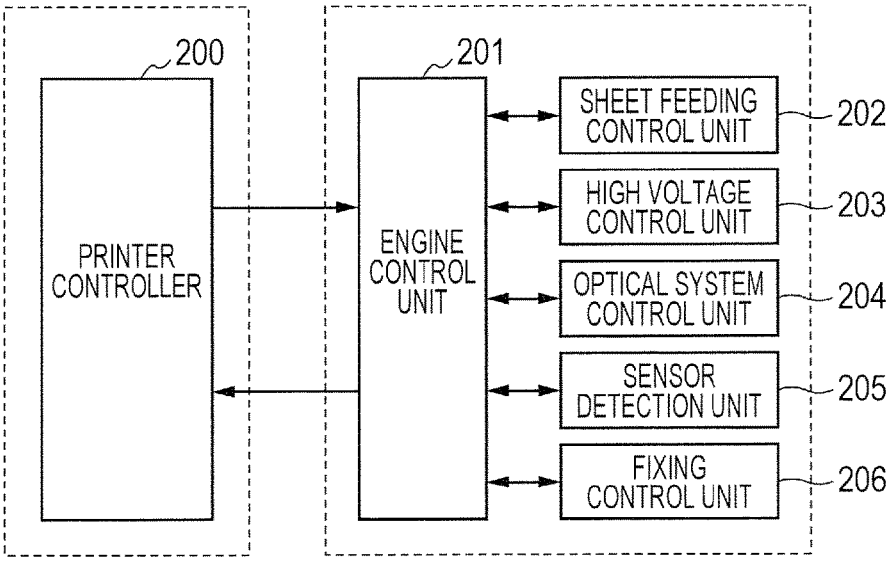
FIGS. 3A and 3B are block diagrams for illustrating a system configuration of the image forming apparatus according to the first embodiment.

Next, a system configuration of the printer 100 as the image forming apparatus according to this embodiment is described. FIG. 3A is a control block diagram for illustrating a configuration of a control system for controlling the printer 100 illustrated in FIG. 1. With reference to FIG. 3A, a printer controller 200 develops an image code received from an external device such as a host computer into bit data necessary for printing. Further, the printer controller 200 reads internal information of an engine control unit 201 (for example, jam occurrence information) through serial communication to/from the engine control unit 201 and displays the internal information on a display portion (not shown). The engine control unit 201 as a control unit controls the control units described below based on instruction information received from the printer controller 200 through serial communication to/from the printer controller 200. Further, the engine control unit 201 includes a system timer (see FIG. 3B) and a timer for measuring a time period that are described above. Note that, the engine control unit 201 includes a ROM and a RAM as storage portions therein, and performs image formation control in accordance with various kinds of control programs stored in the ROM while using the RAM as a work area. The engine control unit 201 stores, in the RAM, size information of the recording material that is set in the instruction information received from the printer controller 200.

A sheet feeding control unit 202 controls the pickup solenoid, the sheet feed motor, and the pickup roller 50 described above so that the recording material S may be conveyed to the registration sensor 21. A high voltage control unit 203 outputs and stops the output of high voltages of a charge voltage, a development voltage, the primary transfer voltage, and the secondary transfer voltage. An optical system control unit 204 drives and stops a scanner motor of the laser scanner 3, and controls on/off of laser light that scans the respective photosensitive drums 1. A sensor detection unit 205 notifies the engine control unit 201 of detection information (detection result) obtained by the registration sensor 21 and the sheet discharge sensor 22. A fixing control unit 206 adjusts a temperature of the fixing roller 31 through supply and stop of the supply of power to the heater 32*h* and drives and stops the fixing motor 23.

[Control Block of Fixing Device Control]

Figure 3B:
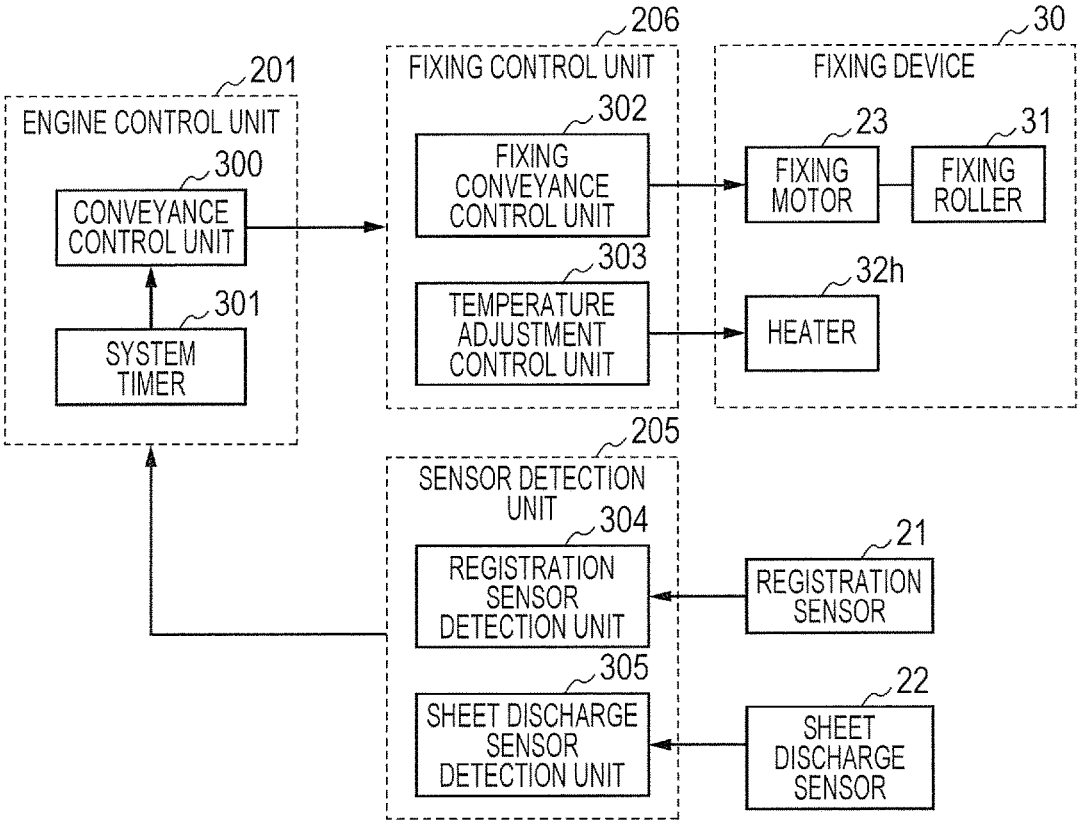

FIG. 3B is a control block diagram for illustrating targets of control by control units, among the control units illustrated in the control block diagram of FIG. 3A, with regard to control of the fixing device 30. With reference to FIG. 3B, the sensor detection unit 205 includes a registration sensor detection unit 304 and a sheet discharge sensor detection unit 305. The registration sensor detection unit 304 notifies the engine control unit 201 of the detection information detected by the registration sensor 21, and the sheet discharge sensor detection unit 305 notifies the engine control unit 201 of the detection information detected by the sheet discharge sensor 22. The fixing control unit 206 includes a fixing conveyance control unit 302 and a temperature adjustment control unit 303. The fixing conveyance control unit 302 rotates and stops the fixing motor 23 in accordance with instruction from the engine control unit 201 or a conveyance control unit 300 to rotate or to stop the fixing roller 31. The temperature adjustment control unit 303 supplies and stops the supply of power to the heater 32*h* so that the temperature of the fixing roller 31 may be controlled as instructed from the engine control unit 201.

The engine control unit 201 includes a system timer 301 for measuring a time period after the printer 100 is turned on. The engine control unit 201 refers to the detection information notified from the registration sensor detection unit 304 and the sheet discharge sensor detection unit 305 of the sensor detection unit 205 and to a timer value of the system timer 301, and determines whether or not a winding jam occurred in the fixing device 30. When the engine control unit 201 determines that a winding jam occurred, the engine control unit 201 notifies the conveyance control unit 300 of the occurrence of the winding jam. When the conveyance control unit 300 configured to solve a winding jam is notified of the occurrence of the winding jam by the engine control unit 201, the conveyance control unit 300 controls drive of the fixing motor 23 configured to drive the fixing roller 31 so that the conveyance of the recording material S may be stopped at a position at which the jammed sheet can be removed with ease. Specifically, after a predetermined time period elapses based on a time indicated by the system timer 301 when the registration sensor 21 detects that a trailing edge of the recording material S passes through the registration sensor 21, the conveyance control unit 300 instructs the fixing conveyance control unit 302 to stop the fixing motor 23.

[Jam of Recording Material in Fixing Device]

Next, a winding jam in the image forming apparatus according to this embodiment is described. During printing operation, the recording material S is wound midway around the fixing roller 31 of the fixing device 30. FIG. 2B is an illustration of an accordion-like state of the recording material S on the conveyance path between the fixing device 30 and the sheet discharge sensor 22 when a jam of the recording material S that is about to be discharged from the sheet discharge roller 34 occurs for some reason. In FIG. 2B, the recording material S that is jammed is denoted as S' and is illustrated by the broken line. When the recording material S passing through the fixing device 30 is normally conveyed, the leading edge of the recording material S pushes down the flag F of the sheet discharge sensor 22, and after that, when the trailing edge of the recording material S passes through the sheet discharge sensor 22, the flag F returns to its original state (state of blocking the recording material S being conveyed). Based on the state of the flag F, the sheet discharge sensor 22 detects the passage of the trailing edge of the recording material S, and as a result, the rotation of the fixing roller 31 is stopped.

On the other hand, even under a state in which the conveyance of the leading edge of the recording material S is stopped for some reason (jammed state), if the state in which the jammed recording material S' presses down the flag F continues, the fixing roller 31 continues to rotate, and the recording material S' is jammed to the leading edge side into the shape of accordion pleats. Further, if the fixing roller 31 still continues to rotate, there may be cases in which the recording material S' bends midway to be wound around the fixing roller 31. Then, as the fixing roller 31 rotates, the recording material S' wound around the fixing roller 31 enters the nip portion N2 in which the fixing roller 31 is in contact with the heating unit 32U. In the case of an externally heating type fixing device, the jammed recording material S' sticks to the fixing roller 31 due to adhesion of the toner thereon. However, the heater 32*h* as the heating member forms the nip portion N2, and thus, when the recording material S' passes through the nip portion N2, the toner is melted again, and the recording material S' after passing through the nip portion N2 is easy to separate from the fixing roller 31.

In particular, in the fixing device 30 according to this embodiment, the plate-like heater 32*h* is pressed against the fixing roller 31 to form the nip portion N2, and the nip portion N2 is in a flat shape. Therefore, the jammed recording material S' is discharged in a direction of a tangent to the surface of the fixing roller 31 at a position at which the fixing roller 31 is in contact with the heater 32*h*, that is, toward the transfer belt cleaning device 16 and the secondary transfer roller 20. In other words, the jammed recording material S' is discharged to an upstream side in the conveyance direction of the recording material. Further, if the fixing roller 31 still continues to rotate, the leading edge side of the recording material S' in the accordion-like state is also drawn into the nip portion N2, and, as a result, the flag F that is pressed down by the leading edge of the recording material S' returns to its original state, that is, the state in which the recording material S' is not detected. This leads to erroneous detection by the sheet discharge sensor 22 that the trailing edge of the recording material S passes through the sheet discharge sensor 22, and the rotation of the fixing roller 31 is stopped. FIG. 2B is a schematic view for illustrating this state.

[Solution of Jammed Sheet in Fixing Device]

Figure 4A:
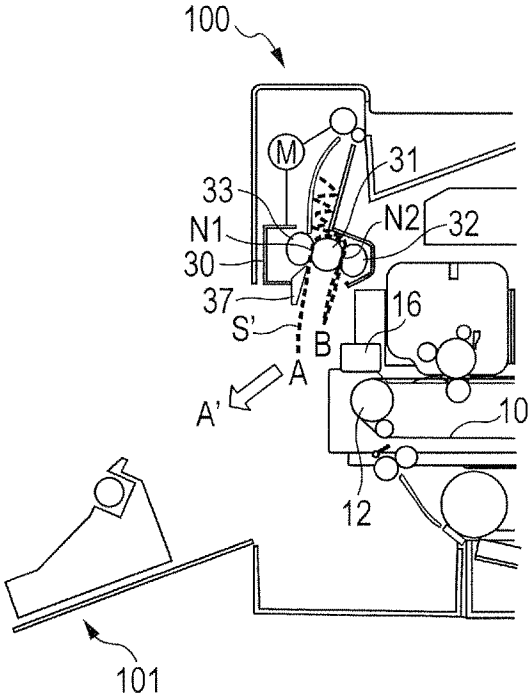
FIGS. 4A, 4B and 4C are schematic views for illustrating how to solve a winding jam according to the first embodiment.

Next, a solution of a jam by removing the recording material S' causing a winding jam is described. FIG. 4A is a schematic view for illustrating a related-art state of a recording material immediately after a winding jam thereof is detected. When the recording material is wound around the fixing roller 31, operation to solve the jam by removing the wound recording material is hitherto difficult. Thus, in a related-art image forming apparatus, when a jam is detected, control is performed so that conveyance of the recording material may be stopped as promptly as possible.

FIG. 4A is an illustration of a state in which the rear cover 101 is open (released state) so that a user may solve a winding jam that is detected. At this time, the user sees an end portion A that is a trailing edge of the jammed recording material S' and an end portion B that is bent midway. In this case, the user can remove the recording material S' by grabbing any one of the end portions A and B in FIG. 4A, but it is likely that the user grabs the end portion A of the recording material S' at a position closer to the user, which is easy to visually recognize and grab, and pulls the end portion A in a direction of an arrow A' to remove the jammed sheet.

Figure 4B:
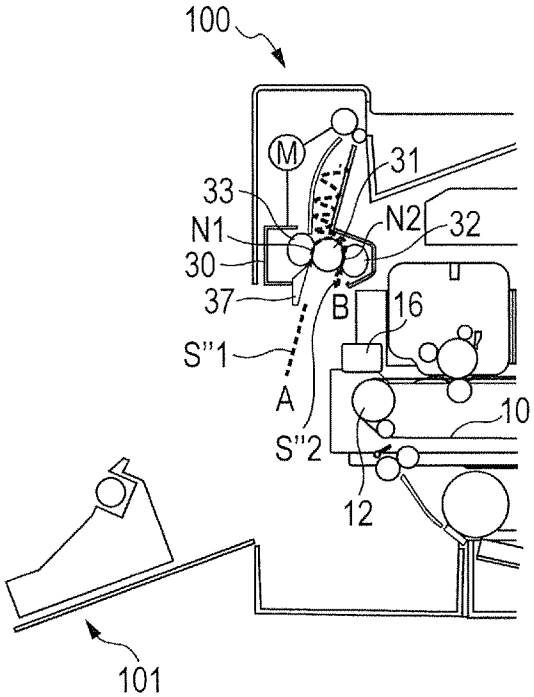

However, with reference to FIG. 4A, the recording material S' is nipped at two positions, namely, the nip portions N1 and N2, and thus, there are cases in which, if the recording material S' is strongly pulled, the recording material S' is torn. Further, the direction of the pull is opposite to the conveyance direction of the recording material S', and thus, the load on the recording material S' increases, which increases the possibility that the recording material S' is torn. Specifically, as illustrated in FIG. 4B, the recording material S' is torn in two at the nip portion N1 to be separated into a recording material S"1 including the end portion A and a recording material S"2 including the end portion B that has returned toward the fixing roller 31 by being pulled in the direction of the arrow A'. As a result, the recording material S"2 remains in the apparatus as a jammed sheet that is difficult to remove.

Figure 4C:
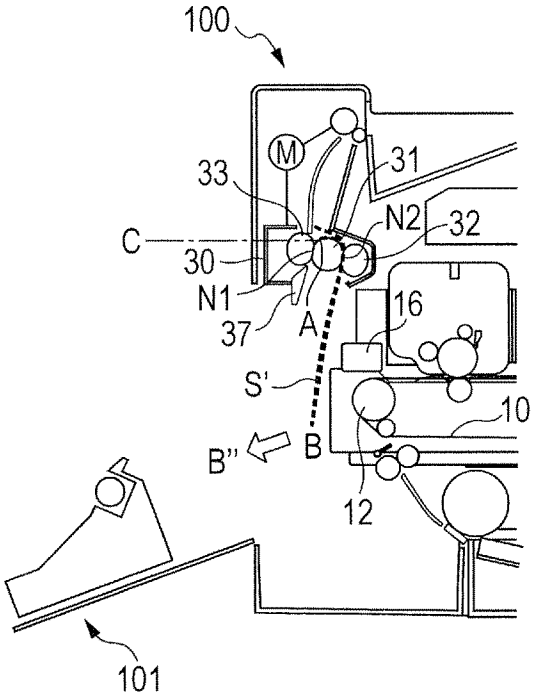

Therefore, according to this embodiment, as illustrated in FIG. 4C, when a winding jam is detected, after the end portion A of the jammed recording material S' is conveyed to a predetermined position, the rotation of the fixing roller 31 is stopped. The predetermined position as used herein refers to a position C at which it is difficult for a user to visually recognize the end portion A, which is the trailing edge of the jammed recording material S', and at which the recording material S' is not nipped at the nip portion N1. As illustrated in FIG. 4C, the end portion A of the jammed recording material S' is at the position C in the vicinity of the nip portion N1 on a downstream side in the conveyance path, and the jammed recording material S' is in a state of being nipped only at the nip portion N2. Therefore, when a user opens the rear cover 101 in order to solve the jam, the user can visually recognize only the end portion B of the recording material S'. The user grabs the end portion B of the recording material S' and pulls the end portion B in a direction of an arrow B" in FIG. 4C to remove the recording material S', thereby solving the jam. In this case, the user pulls the end portion B along the conveyance direction of the recording material S', and thus, the load on the recording material S' is reduced, thereby reducing the possibility of the recording material S' being torn. As a result, the user can solve the jam with ease.

[Jam Detection in Fixing Device]

Figure 5:
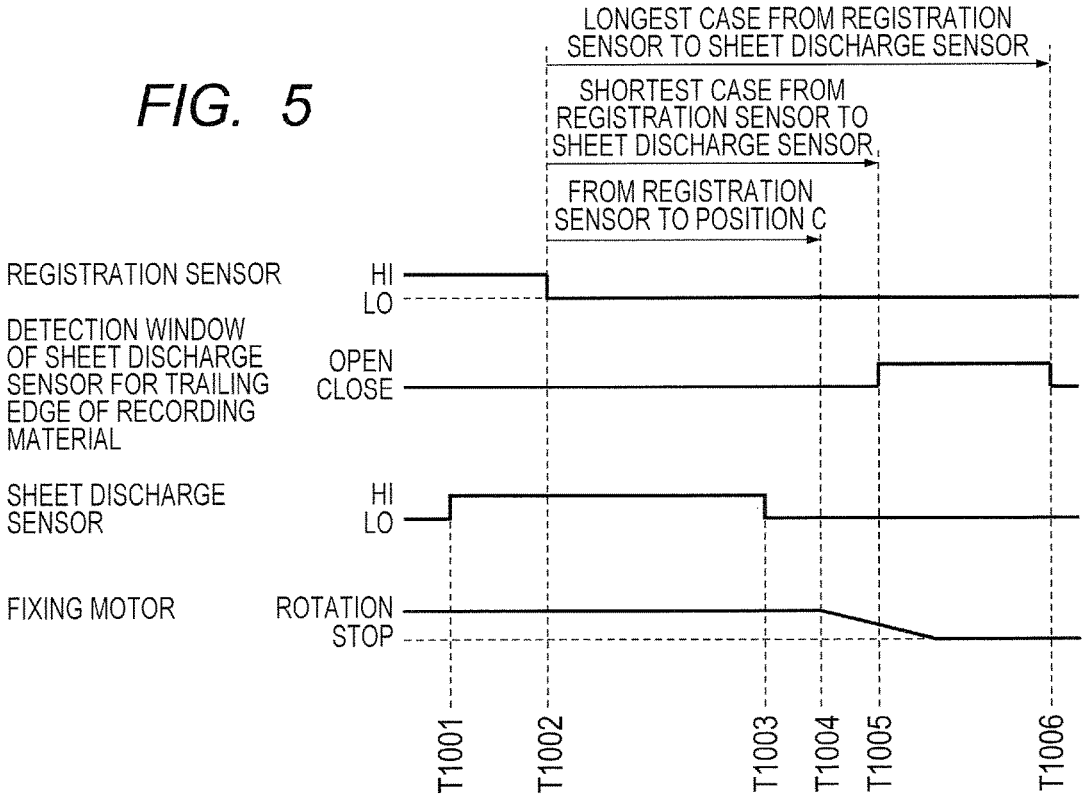
FIG. 5 is a timing chart from winding jam detection to conveyance stop in the first embodiment.

FIG. 5 is a timing chart from winding jam detection based on a timing at which the recording material S passes through the sheet discharge sensor 22 to conveyance of the end portion A of the recording material S to the position C. A horizontal axis in FIG. 5 denotes time, and T1001 to T1006 denote timings (times). With reference to FIG. 5, a vertical axis denotes states of the registration sensor 21, a detection window of the sheet discharge sensor for the trailing edge of the recording medium (hereinafter also referred to as detection window), the sheet discharge sensor 22, and the fixing motor 23, respectively, in the order from top to bottom. A high level ("HI" in FIG. 5) of the registration sensor 21 indicates a state in which the registration sensor 21 detects the recording material S, and a low level ("LO" in FIG. 5) thereof indicates a state in which the registration sensor 21 does not detect the recording material S. A high level ("HI" in FIG. 5) of the sheet discharge sensor 22 indicates a state in which the sheet discharge sensor 22 detects the recording material S, and a low level ("LO" in FIG. 5) thereof indicates a state in which the sheet discharge sensor 22 does not detect the recording material S. "ROTATION" of the fixing motor 23 indicates a state in which the fixing motor 23 is driven to rotate the fixing roller 31, and "STOP" thereof indicates a state in which the drive of the fixing motor 23 is stopped to stop the rotation of the fixing roller 31.

The detection window is a window that defines a timing at which the trailing edge of the recording material S passes through the sheet discharge sensor 22 for the purpose of detecting whether or not the recording material S is normally conveyed without being jammed in the fixing device 30. Timings at which the detection window according to this embodiment is opened ("OPEN" in FIG. 5) and closed ("CLOSE" in FIG. 5) are as follows. Specifically, the detection window is opened at a timing (T1005) at which the trailing edge of the recording material S passes through the sheet discharge sensor 22, after passing through the registration sensor 21, in a shortest case ("SHORTEST CASE FROM REGISTRATION SENSOR TO SHEET DISCHARGE SENSOR" in FIG. 5), which is a predetermined time. Then, the detection window is closed at a timing (T1006) at which the trailing edge of the recording material S passes through the sheet discharge sensor 22, after passing through the registration sensor 21, in a longest case ("LONGEST CASE FROM REGISTRATION SENSOR TO SHEET DISCHARGE SENSOR" in FIG. 5). Note that, the timings T1005 and T1006 are determined based on a length of the conveyance path from the registration sensor 21 to the sheet discharge sensor 22, a conveyance speed of the recording material S, variations (tolerance) in the diameter of the fixing roller 31, and the like.

When the sheet discharge sensor 22 detects that the leading edge of the recording material S reaches the sheet discharge sensor 22, an output thereof is switched from the low (LO) level to the high (HI) level, and the sheet discharge sensor detection unit 305 of the sensor detection unit 205 notifies the engine control unit 201 of the detection information obtained by the sheet discharge sensor 22. When the engine control unit 201 is notified that the high level is output by the sheet discharge sensor 22, the engine control unit 201 starts jam detection control (T1001).

When the registration sensor 21 detects that the trailing edge of the recording material S passes through the registration sensor 21, an output thereof is switched from the high (HI) level to the low (LO) level, and the registration sensor detection unit 304 of the sensor detection unit 205 notifies the engine control unit 201 of the detection information obtained by the registration sensor 21. When the engine control unit 201 is notified that the low level is output by the registration sensor 21, the engine control unit 201 refers to the system timer and stores the time T1002. Further, the engine control unit 201 resets the timer for measuring timings at which the detection window described above is opened and closed and starts the timer (T1002).

When the sheet discharge sensor 22 detects that the trailing edge of the recording material S passing through the fixing device 30 passes through the sheet discharge sensor 22, the sheet discharge sensor 22 outputs the low (LO) level (T1003), and the sheet discharge sensor detection unit 305 of the sensor detection unit 205 notifies the engine control unit 201 of the detection information obtained by the sheet discharge sensor 22. When the engine control unit 201 is notified that the low level is output by the sheet discharge sensor 22, the engine control unit 201 refers to a timer value of the timer for measuring timings for the detection window, and confirms whether or not the detection window is in the open state. When the timer value of the timer indicates that the detection window is in the open state at the timing, the engine control unit 201 determines that the recording material S is not jammed in the fixing device 30. On the other hand, when the timer value of the timer indicates that the present time is earlier than the timing (T1005) at which the detection window is opened, the engine control unit 201 determines that a winding jam of the recording material S occurred in the fixing device 30. Then, the engine control unit 201 notifies the conveyance control unit 300 of the occurrence of the winding jam, and instructs the conveyance control unit 300 to perform control for solving the jam.

As described above, the engine control unit 201 determines whether or not a winding jam occurred based on the time period from the timing at which the trailing edge of the recording material S passes through the registration sensor 21 to the timing at which the trailing edge of the recording material S passes through the sheet discharge sensor 22. For example, the engine control unit 201 can determine whether or not a winding jam occurred based on the time period from the timing at which the leading edge of the recording material S is detected by the sheet discharge sensor 22 to the timing at which the trailing edge of the recording material S passes through the sheet discharge sensor 22. Specifically, when the engine control unit 201 is notified that the sheet discharge sensor 22 outputs the high level (T1001), the engine control unit 201 resets and starts the timer in order to measure a time period necessary for the recording material S to pass through the sheet discharge sensor 22. When the engine control unit 201 is notified that the sheet discharge sensor 22 outputs the low level, the engine control unit 201 stops the timer, and, based on the timer value that is read and on the conveyance speed of the recording material S, variations (tolerance) in the diameter of the fixing roller 31, and the like, calculates a length of the recording material S in the conveyance direction. The engine control unit 201 compares the calculated length of the recording material S in the conveyance direction with the length in the conveyance direction corresponding to the size information of the recording material from the printer controller 200 that is stored in the RAM, and determines whether or not a winding jam occurred. When the calculated length of the recording material S in the conveyance direction is smaller than the length in the conveyance direction corresponding to the size information of the recording material stored in the RAM, the engine control unit 201 determines that a winding jam of the recording material S occurred in the fixing device 30. Then, the engine control unit 201 notifies the conveyance control unit 300 of the occurrence of the winding jam and instructs the conveyance control unit 300 to perform control for solving the jam.

Further, the engine control unit 201 determines that a jam of the recording material S occurred in the fixing device 30 as well when, even after the timing (T1006) at which the detection window is closed, the sheet discharge sensor 22 is not notified of the output of the low level. The jam in this case is, for example, a jam in which the trailing edge of the recording material S passed through the nip portion N1 but the recording material S is bent midway while being conveyed into an accordion-like state, and the recording material S is retained in the conveyance path with the flag F being pressed down. Such a jam in this case is different from the winding jam described in this embodiment, and is thus solved by a publicly known method. Therefore, description thereof is omitted in this embodiment.

The conveyance control unit 300 notified of the occurrence of a winding jam by the engine control unit 201 does not stop the drive of the fixing motor 23, and allows the drive to continue. The conveyance control unit 300 refers to the system timer 301, and when detecting that the predetermined time period elapses, the conveyance control unit 300 instructs the fixing conveyance control unit 302 of the fixing control unit 206 to stop the drive of the fixing motor 23 (T1004). In accordance with the instruction from the conveyance control unit 300, the fixing conveyance control unit 302 stops the drive of the fixing motor 23 to stop the rotation of the fixing roller 31. Note that, the predetermined time period refers to a time period necessary for the trailing edge of the recording material S to be conveyed to the position C (FIG. 4C) described above from the time (T1002) at which the registration sensor 21 detects the passage of the trailing edge of the recording material S. Further, in this case, the system timer 301 is referred to in detecting the elapse of the predetermined time period, but, for example, a timer may be used in detecting the elapse of the predetermined time period. Specifically, the conveyance control unit 300 notified of the occurrence of the winding jam by the engine control unit 201 can detect that the predetermined time period elapses through reset and start of the timer and with reference to a timer value thereof.

[Control Sequence for Solving Jam in Fixing Device]

Figure 6:
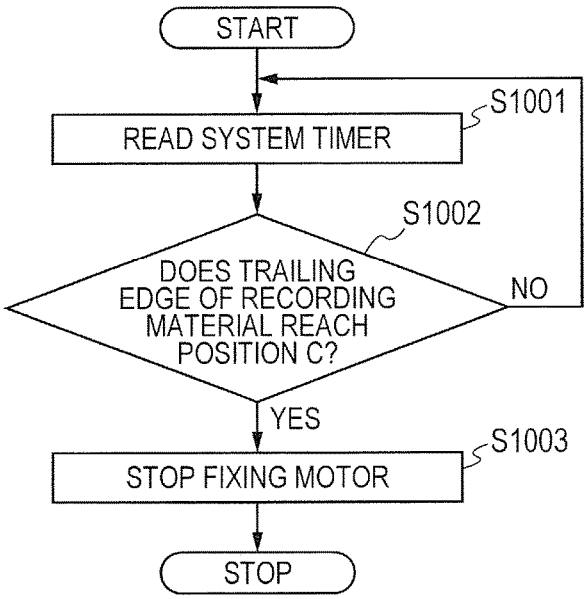
FIG. 6 is a flow chart for illustrating a control sequence for solving a winding jam according to the first embodiment.

FIG. 6 is a flow chart for illustrating a control sequence performed by the conveyance control unit 300 notified of the occurrence of a winding jam by the engine control unit 201. In Step S1001, the conveyance control unit 300 obtains a present time from the system timer 301 ("READ SYSTEM TIMER" in FIG. 6). In Step S1002, the conveyance control unit 300 determines whether or not the trailing edge of the recording material S reaches the position C. Specifically, the conveyance control unit 300 determines whether or not the predetermined time period necessary for the recording material S to be conveyed from the registration sensor 21 to the position C elapses based on the present time obtained in Step S1001 and on the time (T1002) at which the trailing edge of the recording material S passes through the registration sensor 21. When the conveyance control unit 300 determines that the predetermined time period elapses, the process proceeds to Step S1003, and when the conveyance control unit 300 determines that the predetermined time period does not elapse, Step S1002 is repeated. In Step S1003, the conveyance control unit 300 instructs the fixing conveyance control unit 302 of the fixing control unit 206 to stop the fixing motor 23 for the purpose of stopping the conveyance of the recording material S, and the process ends. In accordance with the instruction from the conveyance control unit 300, the fixing conveyance control unit 302 stops the drive of the fixing motor 23, and as a result, the rotation of the fixing roller 31 is stopped, to thereby stop the conveyance of the recording material S.

As described above, in the image forming apparatus including an externally heating type fixing device according to this embodiment, when a winding jam occurs in the fixing device, after the trailing edge of the jammed recording material S passes through the nip portion N1 and is conveyed to the position C, the conveyance of the recording material S is stopped. With this process, when a user opens the rear cover 101 in order to solve the jam, an end portion of the recording material S that is visually recognized can be only the end portion B discharged from the nip portion N2. The user can remove the jammed sheet by pulling the visually recognized end portion B of the recording material S. The possibility of the recording material S being torn is lower than that when the recording material S is nipped at the two positions of the nip portions N1 and N2, and the jam can be solved with ease. Further, the direction in which the user pulls the recording material S is the same as the direction in which the fixing roller 31 rotates when the recording material S is conveyed, and thus, there is no fear that the fixing roller 31 and the like are affected when the jammed sheet is removed. Note that, in this embodiment, the color laser printer 100 is described as an example of the image forming apparatus, but the present invention is also applicable to, for example, a monochrome printer, as long as an image forming apparatus includes an externally heating type fixing device.

As described above, according to this embodiment, usability can be improved when a winding jam in the fixing device is solved.

Second Embodiment

In the fixing device 30 of the printer 100 according to the first embodiment, the fixing roller 31 is in contact with the film 33 of the pressure unit 33U and the film 32 of the heating unit 32U, and the nip portions N1 and N2 are formed at all times. In a second embodiment of the present invention, solving a jam is described in the printer 100 including the fixing device 30 that has a pressure adjusting mechanism configured to adjust pressures applied by the springs 38 and 39 configured to press the heater 32*h* and the pad 33P, respectively, against the fixing roller 31.

[Structure of Fixing Device]

A structure of the fixing device (fixing portion) 30 according to this embodiment is described with reference to FIG. 7A. FIG. 7A is a schematic sectional view in the vicinity of the fixing device 30 of the printer 100 according to this embodiment illustrated in FIG. 1. The fixing device 30 according to this embodiment is also an externally heating type fixing device as in the first embodiment. With reference to FIG. 7A, the springs 38 and 39 are arranged for the heater 32*h* and the pad 33P to press the heater 32*h* and the pad 33P, respectively, against the fixing roller 31. The springs 38 and 39 bring the heater 32*h* and the pad 33P into contact with the fixing roller 31 and move the heater 32*h* and the pad 33P away from the fixing roller 31, respectively, depending on the direction of the rotation of the fixing motor 23. For example, as illustrated in FIG. 7A, by reversely rotating the fixing motor 23, the pressures applied by the springs 38 and 39 to press the heater 32*h* and the pad 33P, respectively, against the fixing roller 31 are reduced. As a result, the heater 32*h* and the pad 33P move in directions of the hollow arrows, respectively, in FIG. 7A (move away from the fixing roller 31), and the nip portions N2 and N1 are no longer formed. The structure of the printer 100 and other structures of the fixing device 30 according to this embodiment are the same as those described in the first embodiment except for this point, and like reference numerals are used to designate members similar to those in the first embodiment and description thereof is omitted here.

[Control Block of Fixing Device Control]

Figure 8A:
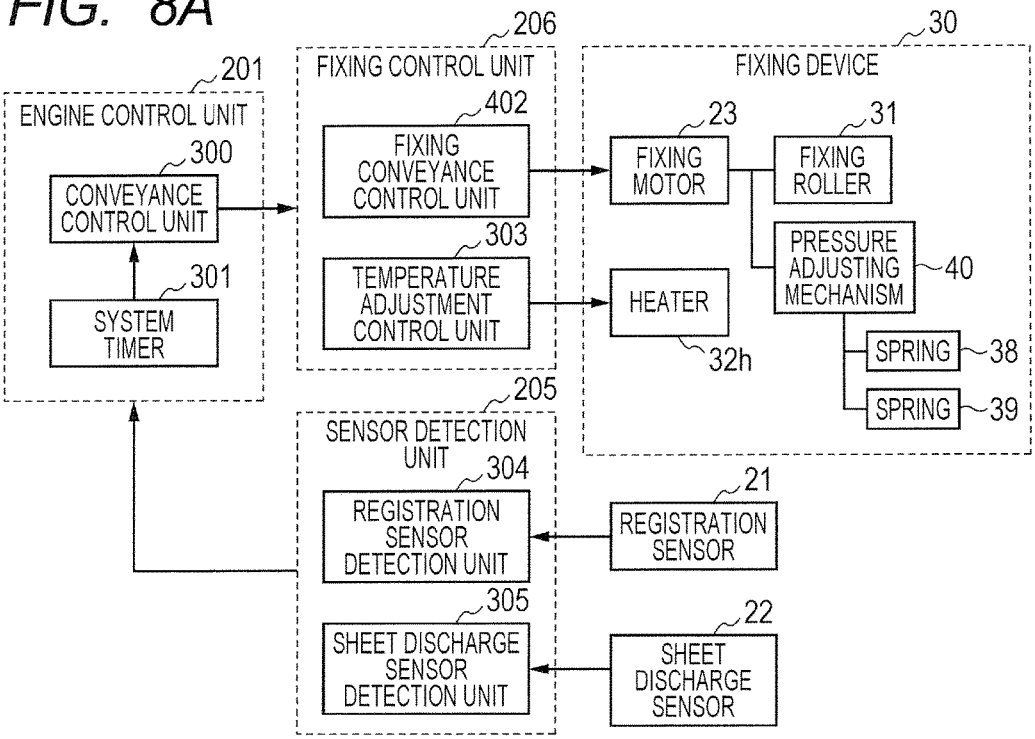
FIG. 8A is a block diagram for illustrating a system configuration of an image forming apparatus according to the second embodiment.

FIG. 8A is a control block diagram for illustrating targets of control by the control units with regard to control of the fixing device 30 according to the second embodiment. FIG. 8A is different from FIG. 3B for illustrating the first embodiment in that a fixing conveyance control unit 402 of the fixing control unit 206 is included. Further, the fixing device 30 includes a pressure adjusting mechanism 40 configured to adjust the pressures applied by the springs 38 and 39. Other control units and detection units are similar to those described in the first embodiment with reference to FIG. 3B, and like reference numerals are used to designate members similar to those in the first embodiment and description thereof is omitted here.

The fixing conveyance control unit 402 controls forward rotation or stop of the fixing motor 23 in accordance with instruction from the engine control unit 201 or the conveyance control unit 300 to rotate or stop the fixing roller 31, thereby rotating or stopping the fixing roller 31. Further, when instruction to reduce the pressures is received from the conveyance control unit 300, the fixing conveyance control unit 402 reversely rotates the fixing motor 23. When the fixing motor 23 is reversely rotated, the pressure adjusting mechanism 40 reduces the pressures applied by the spring 38 and the spring 39 to move the heater 32*h* and the pad 33P away from the fixing roller 31. On the other hand, when the fixing motor 23 is forwardly rotated for the purpose of fixing an image on the recording material S, the pressure adjusting mechanism 40 increases the pressures applied by the spring 38 to press the heater 32*h* against the fixing roller 31 and applied by the spring 39 to press the pad 33P against the fixing roller 31, respectively. This forms the nip portion N1 between the pad 33P and the fixing roller 31 and the nip portion N2 between the heater 32*h* and the fixing roller 31.

[Solution of Jammed Sheet in Fixing Device]

Figure 7B:
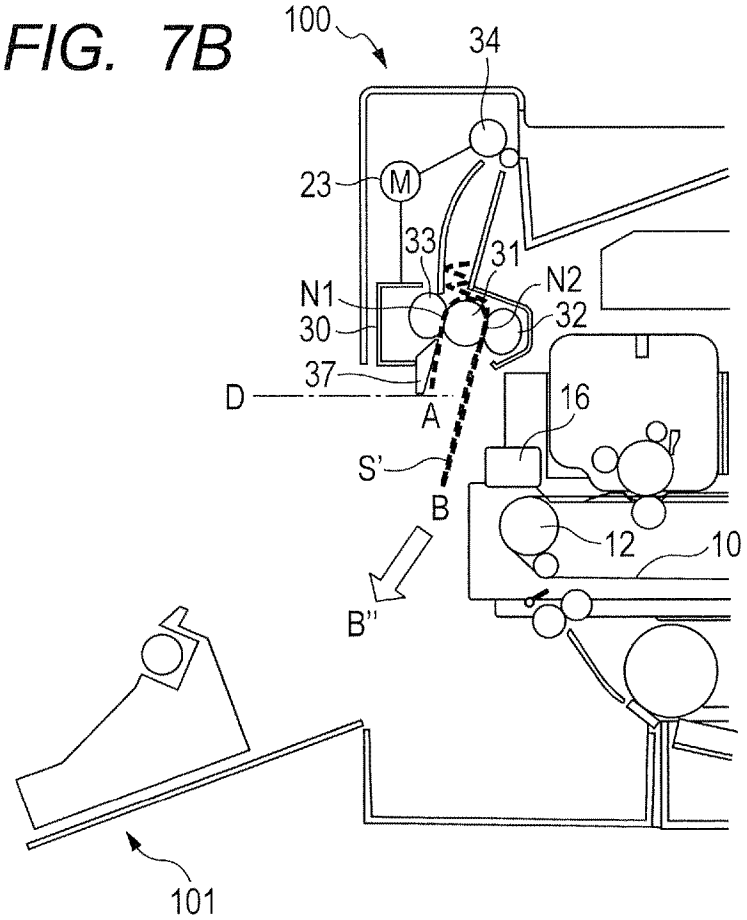
FIGS. 7B and 7C are schematic views for illustrating how to solve a winding jam according to the second embodiment.
Figure 7A:
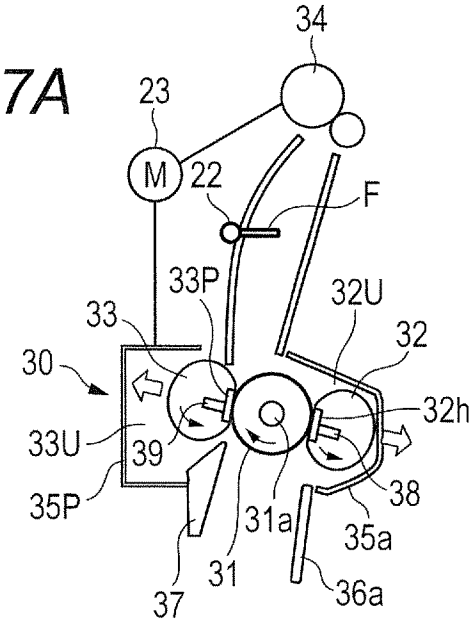
FIG. 7A is a schematic sectional view of a fixing device according to the second embodiment.

According to this embodiment, as illustrated in FIG. 7B, when a winding jam is detected, the end portion A that is the trailing edge of the jammed recording material S' is conveyed to a position D at which, when the rear cover 101 is opened, it is difficult for a user to visually recognize the end portion A. In this case, the position D is a position closer to the nip portion N1 than an end portion of the guide 37 on an upstream side in the conveyance path is, and a position at which, when the rear cover 101 is opened, it is difficult for a user to visually recognize the end portion A of the jammed recording material S'. The jammed recording material S' is retained between the nip portions N1 and N2. However, due to the reduction of the pressures described above, the heater 32*h* and the pad 33P are away from the fixing roller 31. Therefore, the user can remove the jammed sheet by pulling, in the direction of the arrow B", the end portion B of the jammed recording material S' that can be visually recognized when the rear cover 101 is opened.

[Jam Detection in Fixing Device]

Figure 8B:
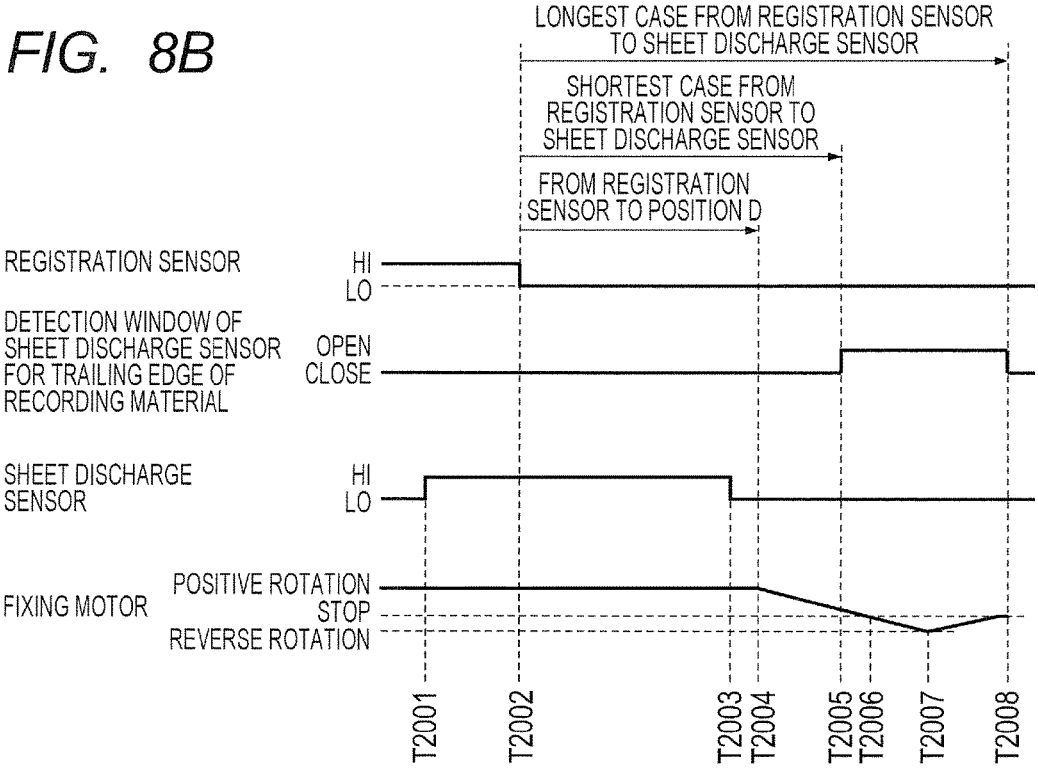
FIG. 8B is a timing chart from winding jam detection to conveyance stop in the second embodiment.

FIG. 8B is a timing chart from winding jam detection based on a timing at which the recording material S passes through the sheet discharge sensor 22 to conveyance of the end portion A of the recording material S to the position D. A horizontal axis in FIG. 8B denotes time, and T2001 to T2008 denote timings (times). Note that, the timings T2001, T2002, T2003, T2005, and T2008 are timings corresponding to the timings T1001, T1002, T1003, T1005, and T1006, respectively, in the first embodiment described with reference to FIG. 5. A timing chart of FIG. 8B with regard to the registration sensor, the detection window of the sheet discharge sensor for the trailing edge of the recording medium, the sheet discharge sensor, and the fixing motor arranged on a vertical axis thereof is similar to the timing chart of FIG. 5 referred to in describing the first embodiment, and description as to how to read the timing chart is omitted. Note that, as described above, the fixing motor 23 according to this embodiment can be rotated not only forwardly but also reversely. Further, a length of the conveyance path from the registration sensor 21 to the position D is smaller than a length of the conveyance path from the registration sensor 21 to the position C, and thus, a time period necessary for the recording material to be conveyed from the registration sensor to the position D is shorter than the time period necessary for the recording material to be conveyed from the registration sensor to the position C illustrated in FIG. 5 referred to in describing the first embodiment.

When the sheet discharge sensor 22 detects that the leading edge of the recording material S passing through the fixing device 30 reaches the sheet discharge sensor 22, the sheet discharge sensor 22 outputs the high (HI) level, and the sheet discharge sensor detection unit 305 of the sensor detection unit 205 notifies the engine control unit 201 of the detection information of the sheet discharge sensor 22. When the engine control unit 201 is notified that the high level is output by the sheet discharge sensor 22, the engine control unit 201 starts jam detection control (T2001).

When the registration sensor 21 detects that the trailing edge of the recording material S passes through the registration sensor 21, the registration sensor 21 outputs the low (LO) level, and the registration sensor detection unit 304 of the sensor detection unit 205 notifies the engine control unit 201 of the detection information obtained by the registration sensor 21. When the engine control unit 201 is notified that the low level is output by the registration sensor 21, the engine control unit 201 refers to the system timer 301 and stores the time T2002. Further, the engine control unit 201 resets the timer for measuring timings at which the detection window is opened and closed and starts the timer (T2002).

When the sheet discharge sensor 22 detects that the trailing edge of the recording material S passing through the fixing device 30 reaches the sheet discharge sensor 22, the sheet discharge sensor 22 outputs the low (LO) level, and the sheet discharge sensor detection unit 305 of the sensor detection unit 205 notifies the engine control unit 201 of the detection information obtained by the sheet discharge sensor 22. When the engine control unit 201 is notified that the low level is output by the sheet discharge sensor 22, the engine control unit 201 refers to a timer value of the timer for measuring timings for the detection window, and confirms whether or not the detection window is in the open state. When the timer value of the timer indicates that the detection window is in the open state at the timing, the engine control unit 201 determines that the recording material S is not jammed in the fixing device 30. On the other hand, when the timer value of the timer indicates that the present time is earlier than the timing at which the detection window of the sheet discharge sensor for the trailing edge of the recording material is opened, the engine control unit 201 determines that a winding jam of the recording material S occurred in the fixing device 30. Then, the engine control unit 201 notifies the conveyance control unit 300 of the occurrence of the winding jam, and instructs the conveyance control unit 300 to perform control for solving the jam. Note that, as described in the first embodiment, the engine control unit 201 can also determine whether or not a winding jam occurred based on the time period from the timing at which the leading edge of the recording material S is detected by the sheet discharge sensor 22 to the timing at which the trailing edge of the recording material S passes through the sheet discharge sensor 22.

Figure 7C:
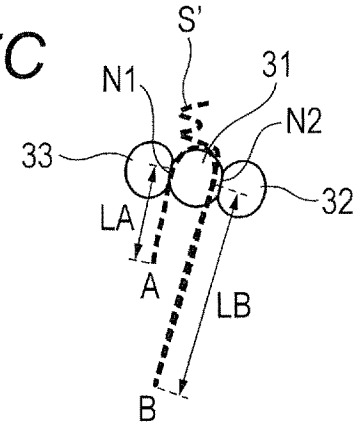

The conveyance control unit 300 notified of the occurrence of a winding jam by the engine control unit 201 refers to the system timer 301, and, when detecting that the predetermined time period elapses, instructs the fixing conveyance control unit 402 of the fixing control unit 206 to stop the drive of the fixing motor 23 (T2004). In accordance with the instruction from the conveyance control unit 300, the fixing conveyance control unit 402 stops the drive of the fixing motor 23 to stop the rotation of the fixing roller 31. Note that, the predetermined time period refers to a time period necessary for the trailing edge of the recording material S to be conveyed to the position D (FIG. 7B) described above from the time (T2002) at which the registration sensor 21 detects that the trailing edge of the recording material S passes through the registration sensor 21. At this time, the jammed recording material S' is stopped under a state in which an exposed length of the end portion B in a direction toward the secondary transfer portion is longer than an exposed length of the end portion A in the direction toward the secondary transfer portion. Further, as used herein, the exposed length of the end portion A in the direction toward the secondary transfer portion refers to a length LA in FIG. 7C, and the exposed length of the end portion B in the direction toward the secondary transfer portion refers to a length LB in FIG. 7C. FIG. 7C is a schematic view in which members except a fixing unit and the recording material S' in FIG. 7B are omitted.

After that, when the rotation of the fixing motor 23 is stopped (T2006), the conveyance control unit 300 instructs the fixing conveyance control unit 402 to reversely rotate the fixing motor 23. In accordance with the instruction from the conveyance control unit 300, the fixing conveyance control unit 402 drives the fixing motor 23 to reversely rotate the fixing motor 23. Then, the pressure adjusting mechanism 40 reduces the pressures applied by the springs 38 and 39 to press the heater 32*h* against the fixing roller 31 and to press the pad 33P against the fixing roller 31, respectively. When the reduction of the pressures applied by the springs 38 and 39 is completed (T2007) and the heater 32*h* and the pad 33P move away from the fixing roller 31, the fixing conveyance control unit 402 stops the reverse rotation of the fixing motor 23 (T2008).

[Control Sequence for Solving Jam in Fixing Device]

Figure 9:
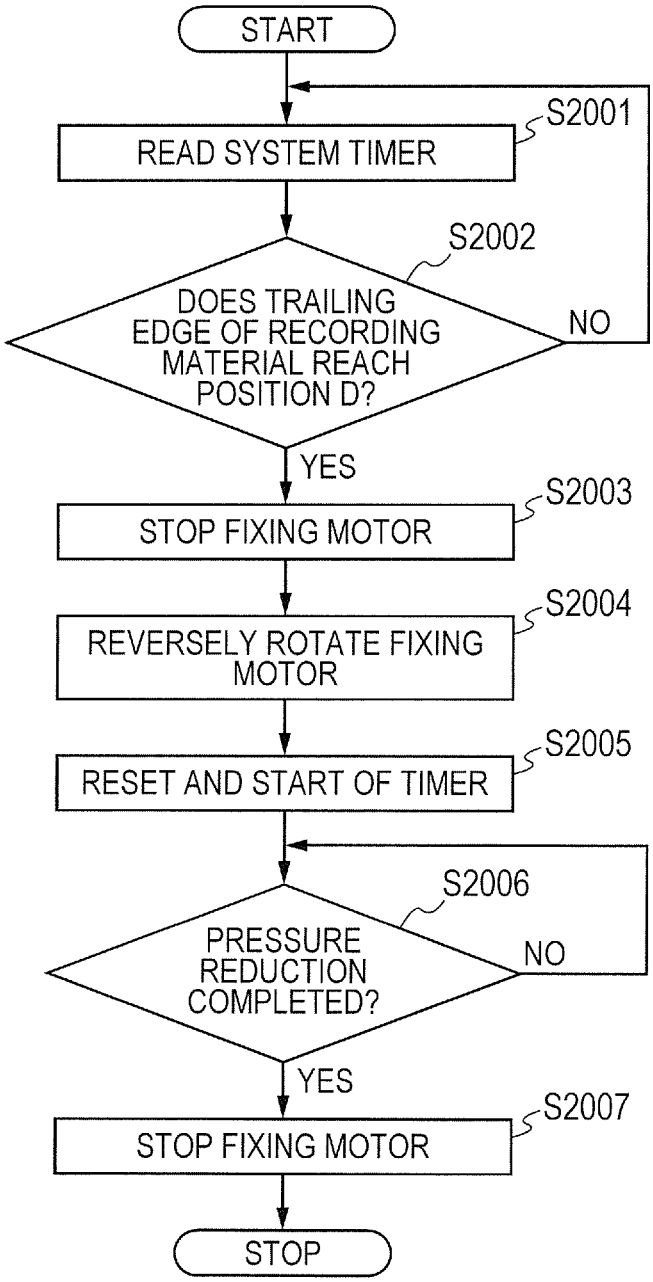
FIG. 9 is a flow chart for illustrating a control sequence for solving a winding jam according to the second embodiment.

FIG. 9 is a flow chart for illustrating a control sequence performed by the conveyance control unit 300 notified of the occurrence of a winding jam by the engine control unit 201. In Step S2001, the conveyance control unit 300 obtains a present time from the system timer 301 ("READ SYSTEM TIMER" in FIG. 6). In Step S2002, the conveyance control unit 300 determines whether or not the trailing edge of the recording material S reaches the position D. Specifically, the conveyance control unit 300 determines whether or not the predetermined time period necessary for the recording material S to be conveyed from the registration sensor 21 to the position D elapses based on the present time obtained in Step S2001 and on the time (T2002) at which the trailing edge of the recording material S passes through the registration sensor 21. When the conveyance control unit 300 determines that the predetermined time period elapses, the process proceeds to Step S2003, and, when the conveyance control unit 300 determines that the predetermined time period does not elapse, Step S2002 is repeated. In Step S2003, the conveyance control unit 300 instructs the fixing conveyance control unit 402 of the fixing control unit 206 to stop the fixing motor 23 for the purpose of stopping the conveyance of the recording material S. In accordance with the instruction from the conveyance control unit 300, the fixing conveyance control unit 402 stops the drive of the fixing motor 23, and, as a result, the rotation of the fixing roller 31 is stopped, and the conveyance of the recording material S is stopped.

In Step S2004, the conveyance control unit 300 instructs the fixing conveyance control unit 402 to reversely rotate the fixing motor 23 so that the pressure adjusting mechanism 40 may reduce the pressures applied by the springs 38 and 39 to move the heater 32*h* and the pad 33P, respectively, away from the fixing roller 31. In accordance with the instruction from the conveyance control unit 300, the fixing conveyance control unit 402 reversely rotates the fixing motor 23. In Step S2005, for the purpose of determining whether or not a time period necessary for reducing the pressures elapses, the conveyance control unit 300 resets and starts the timer. In Step S2006, the conveyance control unit 300 refers to the timer, and determines whether or not the time period necessary for reducing the pressures elapses and whether or not the reduction of the pressures is completed. When the timer value of the timer indicates that the time period necessary for reducing the pressures elapses, the conveyance control unit 300 determines that the reduction of the pressures is completed, and the process proceeds to Step S2007. On the other hand, when the timer value indicates that the time period necessary for reducing the pressures does not elapse, the conveyance control unit 300 determines that the reduction of the pressures is not completed, and Step S2006 is repeated.

The heater 32*h* and the pad 33P are now away from the fixing roller 31, and thus, in Step S2007, the conveyance control unit 300 instructs the fixing conveyance control unit 402 to stop the fixing motor 23. In accordance with the instruction from the conveyance control unit 300, the fixing conveyance control unit 402 stops driving the fixing motor 23 to reversely rotate the fixing motor 23, and the process ends.

As described above, in the image forming apparatus including an externally heating type fixing device according to this embodiment, when a winding jam occurs in the fixing device, after the trailing edge of the jammed recording material S is conveyed to the position D in the vicinity of the guide 37, the conveyance of the recording material S is stopped. Further, through reduction of the pressures, the heater 32*h* and the pad 33P are moved away from the fixing roller 31. As a result, force to pull the jammed sheet necessary for a user to remove the jammed sheet can be small, which can reduce the load. Further, the position D is on the upstream side in the conveyance path with respect to the position C in the first embodiment, and thus, the possibility that the bent end portion of the recording material S' is jammed to be brought into contact with the intermediate transfer belt 10 or the transfer belt cleaning device 16 can be reduced. Further, similarly to the case of the first embodiment, when a user opens the rear cover 101, the user can visually recognize only the end portion B of the jammed recording material S', and thus, the user can remove the jammed sheet by grabbing the end portion B of the recording material S' and pulling the end portion B in the direction of the arrow B".

As described above, according to this embodiment, usability can be improved when a winding jam in the fixing device is solved.

Further, in the embodiments described above, a case in which the leading edge of the recording material S is pulled around the fixing roller 31 after being once detected by the sheet discharge sensor 22, and is again detected by the sheet discharge sensor 22, that is, a case of a so-called midway winding jam, is described as an example. However, the present invention can also be applied to a case in which the leading edge of the recording material S is wound around the fixing roller 31 without being detected by the sheet discharge sensor 22, that is, a case of a so-called leading edge winding jam.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-054897, filed Mar. 18, 2015, which is hereby incorporated by reference herein in its entirety.

What is claimed is:

1. An image forming apparatus, comprising:

a conveyance unit configured to convey a recording material;

a fixing unit configured to fix an image on the recording material conveyed by the conveyance unit;

a driving unit configured to drive the fixing unit; and a control unit configured to control the driving unit, wherein the fixing unit comprises:

a rotation member;

a pressure member configured to form a first nip portion with the rotation member and press the rotation member; and a heating member configured to form a second nip portion with the rotation member and to heat and press the rotation member, the fixing unit fixing the image on the recording material by nipping the recording material at the first nip portion, and wherein the control unit controls the driving unit so that the driving unit continues to drive the fixing unit at least until an exposed length of the recording material from the first nip portion in a direction toward the conveyance unit becomes shorter than an exposed length of the recording material from the second nip portion in the direction toward the conveyance unit, in a state in which the recording material is wound around the rotation member.

2. The image forming apparatus according to claim 1, wherein the fixing unit comprises an adjusting unit configured to adjust a pressure applied by the pressure member to press the rotation member and a pressure applied by the heating member to press the rotation member, and wherein the control unit reduces the pressures applied by the pressure member and the heating member to press the rotation member through control of the adjusting unit in the state in which the recording material is wound around the rotation member.

3. The image forming apparatus according to claim 2, wherein the control unit switches a state in which the pressure member and the heating member are in contact with the rotation member to a state in which the pressure member and the heating member are spaced from the rotation member through control of the adjusting unit in the state in which the recording material is wound around the rotation member.

4. The image forming apparatus according to claim 3, wherein the state in which the pressure member and the heating member are in contact with the rotation member and the state in which the pressure member and the heating member are spaced from the rotation member are switched by switching a direction of rotation of the driving unit.

5. The image forming apparatus according to claim 1, further comprising an apparatus cover, wherein, by opening the apparatus cover, a conveyance path for introducing the recording material into the fixing unit is exposed to an outside of the image forming apparatus so that a user can remove the recording material wound around the rotation member.

6. The image forming apparatus according to claim 1, further comprising a detection unit configured to detect the recording material, wherein the control unit determines that the recording material is wound around the rotation member based on a detection result of the detection unit.

7. The image forming apparatus according to claim 6, wherein the detection unit comprises:

a first detection sensor arranged in a conveyance path for introducing the recording material into the fixing unit; and a second detection sensor arranged in the conveyance path for the recording material discharged from the fixing unit.

8. The image forming apparatus according to claim 7, wherein the control unit determines that the recording material is wound around the rotation member in a state in which a time period, from a timing at which the first detection sensor is switched from a state of detecting the recording material to a state of not detecting the recording material, to a timing at which the second detection sensor is switched from a state of detecting the recording material to a state of not detecting the recording material, is shorter than a predetermined time period.

9. The image forming apparatus according to claim 8, wherein the predetermined time period is determined based on a length of the conveyance path between the first detection sensor and the second detection sensor and a conveyance speed of the recording material.

10. The image forming apparatus according to claim 6, wherein the detection unit comprises:

a detection sensor arranged in a conveyance path for the recording material discharged from the fixing unit.

11. The image forming apparatus according to claim 10, wherein the control unit determines that the recording material is wound around the rotation member in a state in which a time period, from a timing at which the detection sensor is switched from a state of not detecting the recording material to a state of detecting the recording material, to a timing at which the detection sensor is switched from the state of detecting the recording material to the state of not detecting the recording material, is shorter than a predetermined time period.

12. The image forming apparatus according to claim 11, wherein the predetermined time period is determined based on a length of the recording material in a conveyance direction and a conveyance speed of the recording material.

13. The image forming apparatus according to claim 1, wherein the control unit controls the driving unit so that the driving unit continues to drive the fixing unit at least until a trailing edge of the recording material passes through the first nip portion in the state in which the recording material is wound around the rotation member.

14. The image forming apparatus according to claim 13, wherein the control unit is configured to cause the driving unit to drive or to stop, and wherein when the control unit causes the driving unit to stop, the recording material is nipped at the second nip portion.

15. The image forming apparatus according to claim 1, wherein the conveyance unit is a transfer unit configured to transfer, on the recording material, an image formed on an image bearing member.

16. The image forming apparatus according to claim 1, wherein the recording material is nipped at the first nip portion and the second nip portion in the state in which the recording material is wound around the rotation member.

17. An apparatus, comprising:

a rotating unit configured to rotate and convey a recording material;

a driving unit configured to drive the rotating unit; and a control unit configured to control the driving unit, wherein the rotating unit comprises:

a first rotation member;

a second rotation member configured to form a first nip portion with the first rotation member; and a third rotation member configured to form a second nip portion with the first rotation member, the rotating unit conveying the recording material by nipping the recording material at the first nip portion, and wherein the control unit controls the driving unit so that the driving unit continues to drive the rotating unit in a state in which the recording material is wound around the first rotation member, and stops the driving unit in a state in which the recording material is nipped at the second nip portion.

18. The apparatus according to claim 17, further comprising a conveyance unit configured to convey the recording material to the rotating unit, wherein the control unit controls the driving unit so that the driving unit continues to drive the rotating unit at least until an exposed length of the recording material from the first nip portion in a direction toward the conveyance unit becomes shorter than an exposed length of the recording material from the second nip portion in the direction toward the conveyance unit in the state in which the recording material is wound around the first rotation member, and stops the driving unit in the state that the recording material is nipped at the second nip portion.

19. The apparatus according to claim 18, wherein the control unit controls the driving unit so that the driving unit continues to drive the rotating unit at least until a trailing edge of the recording material passes through the first nip portion in the state in which the recording material is wound around the first rotation member, and stops the driving unit in the state in which the recording material is nipped at the second nip portion.

20. The apparatus according to claim 17, further comprising an apparatus cover, wherein, by opening the apparatus cover, a conveyance path for introducing the recording material into the rotating unit is exposed to an outside of the apparatus so that a user can remove the recording material wound around the first rotation member.

21. The apparatus according to claim 17, wherein the recording material is nipped at the first nip portion and the second nip portion in the state in which the recording material is wound around the first rotation member.

* * * * *